US011274483B2

(12) United States Patent
Benedetti et al.

(10) Patent No.: US 11,274,483 B2
(45) Date of Patent: Mar. 15, 2022

(54) HINGE FOR THE ROTATABLE MOVEMENT OF A DOOR OR SIMILAR CLOSING ELEMENT

(71) Applicant: Colcom Group S.p.A., Nave (IT)

(72) Inventors: Luca Benedetti, Nave (IT); Mihai Mesaros, Nave (IT)

( * ) Notice: Subject to any disclaimer, the term of this patent is extended or adjusted under 35 U.S.C. 154(b) by 0 days.

(21) Appl. No.: 17/268,457

(22) PCT Filed: Jul. 30, 2019

(86) PCT No.: PCT/IB2019/056472
§ 371 (c)(1),
(2) Date: Feb. 13, 2021

(87) PCT Pub. No.: WO2020/044143
PCT Pub. Date: Mar. 5, 2020

(65) Prior Publication Data

US 2021/0189782 A1 Jun. 24, 2021

(30) Foreign Application Priority Data

Aug. 29, 2018 (IT) ..... 102018000008233

(51) Int. Cl.
*E05F 3/20* (2006.01)
*E05F 3/10* (2006.01)

(52) U.S. Cl.
CPC ..... *E05F 3/20* (2013.01); *E05F 3/104* (2013.01); *E05Y 2201/638* (2013.01); *E05Y 2900/132* (2013.01); *E05Y 2900/146* (2013.01)

(58) Field of Classification Search
CPC ..... E05F 3/104; E05F 3/10; E05F 3/20; E05F 3/225; E05F 3/227; E05F 3/04; E05Y 2201/638; E05Y 2800/268; E05Y 2800/676; E05Y 2900/132; E05Y 2900/146; E05Y 2900/148; E05Y 2600/452; E05Y 2600/41; E05Y 2201/212; E05D 7/086; E05D 7/10; E05D 3/02; E05D 5/10; E05D 5/14; E05D 9/005;

(Continued)

(56) References Cited

U.S. PATENT DOCUMENTS 2,588,010 A * 3/1952 Kennon ..... E05F 3/104 16/239
2,702,398 A * 2/1955 Marcus ..... E05F 3/02 16/66

(Continued)

FOREIGN PATENT DOCUMENTS

WO 2012076662 6/2012
WO 2016185394 11/2016

*Primary Examiner* — Chuck Y Mah
(74) *Attorney, Agent, or Firm* — Themis Law

(57) ABSTRACT

A hinge for the rotatable movement of a door or a similar closing element anchored to a wall or to a similar stationary support includes a fixed element adapted to be coupled to the wall or similar stationary support and a movable element adapted to be coupled to the door or similar closing element. The fixed and movable elements are coupled to mutually rotate around a first longitudinal axis between an open position and a closed position. The hinge further includes a hydraulic duct with a calibrated passage for s working fluid and an adjustment system acting thereon to control the movement of the door or similar closing element.

11 Claims, 7 Drawing Sheets

(58) Field of Classification Search
CPC ... E05D 11/0054; E05D 11/02; Y10T 16/552; Y10T 16/5525; Y10T 16/56; Y10T 16/593; Y10T 16/2769; Y10T 16/2771; Y10T 16/2774; Y10T 16/283; Y10T 16/304
See application file for complete search history.

(56) References Cited

U.S. PATENT DOCUMENTS 3,072,954 A * 1/1963 Patriquin ..... E05F 3/02 16/66
3,335,451 A * 8/1967 Patriquin ..... E05F 3/108 16/52
3,375,542 A * 4/1968 Gray ..... E05F 3/108 16/52
4,180,888 A * 1/1980 Nagase ..... E05F 3/102 16/10
4,230,309 A * 10/1980 Schnitzius ..... F16F 9/0209 16/66
4,817,238 A * 4/1989 Liu ..... F16F 9/0218 16/58
5,477,589 A * 12/1995 Lan ..... E05F 3/02 16/51
5,502,874 A * 4/1996 Lucas ..... E05F 3/102 16/52
8,875,344 B2 * 11/2014 Salutzki ..... F16K 31/0693 16/53
10,352,079 B2 * 7/2019 Wang ..... E05F 3/12
10,865,597 B2 * 12/2020 Chen ..... F16F 13/007
2010/0287729 A1 * 11/2010 Jin ..... E05F 3/12 16/52
2011/0219583 A1 * 9/2011 Bacchetti ..... E05F 1/1253 16/54
2012/0198654 A1 * 8/2012 Reid ..... E05F 3/12 16/52
2016/0168897 A1 * 6/2016 Miglioranzo ..... E05F 1/105 16/50
2021/0148148 A1 * 5/2021 Weber ..... E05F 3/20

* cited by examiner

HINGE FOR THE ROTATABLE MOVEMENT OF A DOOR OR SIMILAR CLOSING ELEMENT

FIELD OF THE INVENTION

The present invention generally regards the technical field of closing or control hinges, and it particularly regards a hinge for the rotatable movement of a door, a shutter or the like.

STATE OF THE ART

Hinges comprising a hinge body and a pivot mutually coupled to allow a closing element, such as a door, a shutter or the like, to rotate between an open position and a closed position, are known.

In particular, known are hydraulic hinges comprising a plunger element having a slidable disc-shaped head suitable to partition the working chamber into two variable volume compartments.

Thus, known is the need to provide one or more hydraulic ducts to place in fluid communication such variable volume compartments so as to allow the sliding of the plunger element.

As known, the dimension of such hydraulic ducts and in particular of the through-flow openings determines the flow of the liquid passing from one compartment to the other and thus the control of the rotation of the closing element.

Known in the technical field is the difficulty to obtain holes small enough to allow an efficient control of the flow and thus the displacement of the closing element.

On the other hand, known are hinges that at least partly resolve such drawback. An example of such hinges A is schematically shown in FIG. 1 and FIG. 2. In particular, such solution shows two separate ducts B1, B2 and a hole C with large size having a pin E inserted thereinto to narrow the opening through which the working fluid flows.

Thus, such hinges are susceptible to improve, in particular as regards the simplicity of manufacturing the hinge and the costs thereof.

SUMMARY OF THE INVENTION

An object of the present invention is to at least partly overcome the aforementioned drawbacks, by providing a hinge that is highly functional and inexpensive.

Another object of the invention is to provide a hinge that is particularly simple to manufacture.

Another object of the invention is to provide a hinge that is extremely highly durable over time.

These and other objects that will be more apparent hereinafter, are attained by a hinge according to what is described and/or claimed and/or illustrated herein.

Advantageous embodiments of the invention are defined according to the dependent claims.

BRIEF DESCRIPTION OF THE DRAWINGS

Further characteristics and advantages of the invention will be more apparent in light of the detailed description of some preferred but non-exclusive embodiments of the invention, illustrated by way of non-limiting example with reference to the attached drawings, wherein.

DETAILED DESCRIPTION OF SOME PREFERRED EMBODIMENTS

Figure 1:
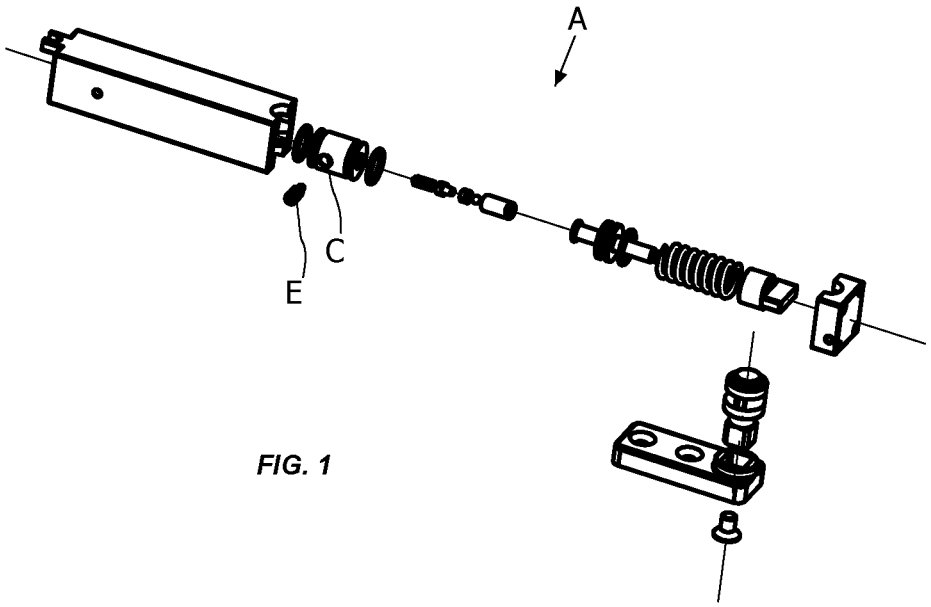
FIG. 1 PRIOR ART
FIG. 1 and FIG. 2 are a respectively exploded and sectional views of a hinge A of the prior art.
Figure 2:
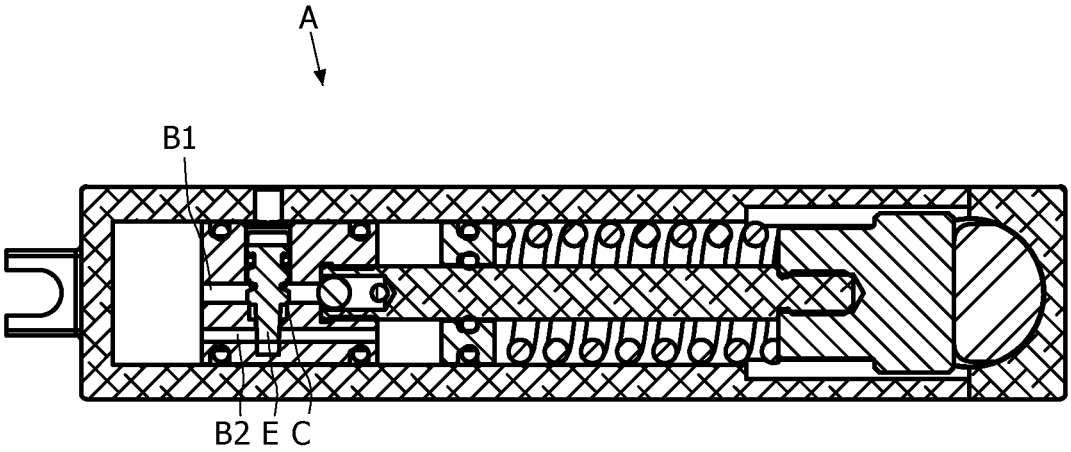
FIG. 2 PRIOR ART
Figure 3:
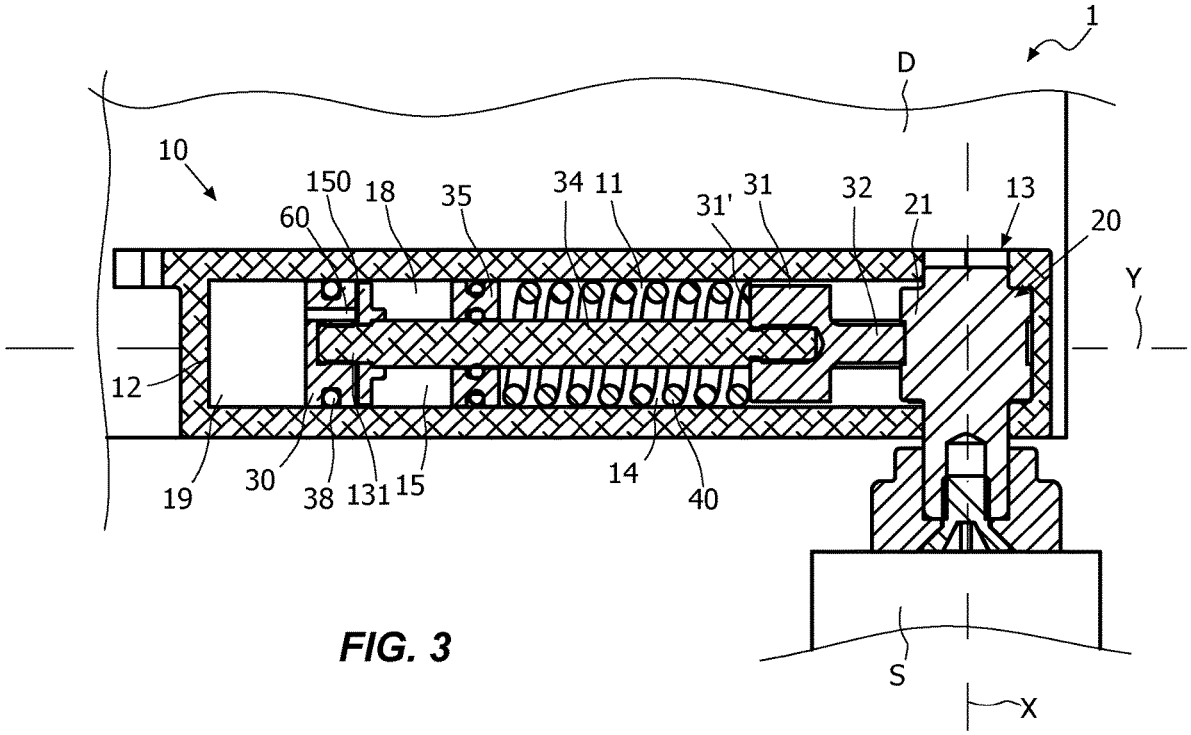
FIG. 3 is a sectional view of a hinge 1.
Figure 4:
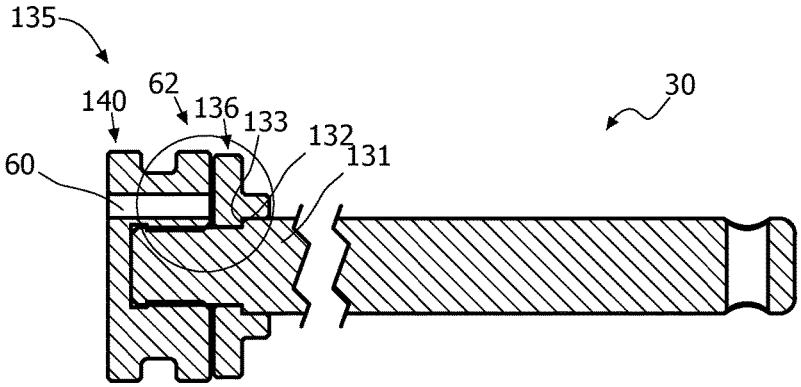
FIG. 4 is a sectional view of some details of the hinge 1.

With reference to the aforementioned figures, the hinge according to the invention, indicated in its entirety with reference number 1, may be advantageously used for glass doors or shutters, such as for example those of a display window or display case.

Generally, the hinge 1 may be suitable to rotatably couple a stationary support structure, for example a frame S, and a closing element, for example a shutter D, rotatably movable between an opening and a closing position around a rotation axis X.

It is clear that even though hereinafter reference shall be made to the frame S and the shutter D, the hinge 1 is applicable to any stationary support structure and to any closing element without departing from the scope of protection of the attached claims.

The hinge 1 shall suitably include a substantially box-shaped hinge body 10 and a pivot 20 defining the rotation axis X.

In a preferred but non-exclusive embodiment, the hinge body 10 may be anchored to the shutter D and the pivot 20 to the frame S, for example by means of a base. In this case, the fixing element will include a pivot 20, while the movable element may include the hinge body 10.

Vice versa, in an embodiment of the invention not illustrated in the attached drawings, the hinge body 10 may be anchored to the frame S, while the pivot 20 may be anchored to the shutter D, without departing from the scope of protection of the attached claims. In this case, the fixed element will include the hinge body 10, while the movable element may include the pivot 20.

Furthermore, it is clear that the hinge 1 must not necessarily include a pivot 20, given that the presence of an operative connection between the fixed and movable elements is sufficient.

Advantageously, the hinge body 10 and the pivot 20 may be mutually coupled to rotate around the axis X between the shutter D open and closed positions.

More in particular, the pivot 20 may be inserted into a substantially cylindrical seat 13 passing through the hinge body 10 having an axis coincident with the axis X.

Preferably, the hinge body 10 may be obtained according to the disclosures provided for by the Italian patent application number 102016000049176, on behalf of the Applicant. In such case, the hinge body 10 is obtained as two parts couplable to each other for obtaining a substantially cylindrical seat 13. Thus, the latter is also obtained as two parts.

In a preferred but non-exclusive embodiment, the hinge body 10 may be configured to rotate around the axis X between a closed position and at least two open positions opposite with respect to the closed position. In other words, the hinge 1 may be ambidextrous, i.e. it can be used on doors or shutters opening to the right and on doors or shutters opening to the left.

The pivot 20 may suitably include a cam element 21 integrally joined thereto using a plunger element 30 slidable along an axis Y.

The sliding axis Y of the plunger element 30 may be substantially perpendicular to the axis X. Furthermore, the rotation axis X of the shutter D may be substantially vertical.

In any case, the plunger element 30, which may be operatively connected with a cylinder 31 by means of a shaft 34, may slide in a working chamber 11 within the hinge body 10 between a retracted end-stroke position proximal to the bottom wall 12 of the working chamber 11, and an extended end-stroke position distal with respect thereto.

Such retracted and extended end-stroke positions may suitably vary, and not necessarily correspond to the maximum distal and/or proximal position that can be taken by the plunger element 30.

In a preferred but non-exclusive embodiment of the invention, the working chamber 11 may include elastic counteracting means acting on the plunger element 30.

In a preferred but non-exclusive embodiment, the elastic counteracting means may include, respectively may consist of a spiral spring 40 with predetermined diameter.

Depending on the configuration, the elastic counteracting means 40 may be thrust or recovery means.

In the case of thrust elastic counteracting means, the force thereof must be such to automatically return the shutter D from the open or closed position that it reaches when the plunger element 30 is in proximal position towards the other of the open or closed position that it reaches when the plunger element 30 is in distal position.

In this case, depending on whether the position reached by the shutter D when the plunger element 30 is in proximal position is open or closed, the hinge 1 will be an opening hinge or a closing hinge or a door closer hinge.

In the case of recovery elastic means, the force thereof must be such not to be able to push the shutter D from the open or closed position that it reaches when the plunger element 30 is in proximal position towards the other of the open or closed position that it reaches when the plunger element 30 is in distal position. In this case, the shutter D must be moved manually or however using external actuator means with respect to the hinge 1, for example a motor.

However, the force of the recovery elastic means, must be such to return the plunger element 30 from the proximal position to the distal position.

In such case, depending on whether the position reached by the shutter D when the cylinder 31 is in proximal position is open or closed, the hinge 1 may be an opening or closing control hinge.

It is clear that the opening or closing hinge will also be used for opening or closing control purposes too, whereas the contrary is untrue.

It is clear that even though the attached figures illustrate a closing hinge 1, the latter may be a closing or opening hinge, just as it could be an opening or closing control hinge without departing from the scope of protection of the attached claims.

The cam element 21 of the pivot 20 may suitably interact with the cam follower means of the cylinder 31 to displace the latter between the distal position and the proximal position.

The cam element 21 and the cam follower means of the cylinder 31 may have different configurations depending on the needs.

For example, the cam element 21 of the pivot 20 may be substantially flat or slightly curve-shaped or it may have several operative surfaces having any angle with respect to each other. On the other hand, according to a different embodiment, the cam element 21 may be configured as a substantially parallelepiped-shaped working wall, with working surfaces substantially perpendicular with respect to each other.

The working chamber 11 may preferably include a working fluid, for example oil, for hydraulically damping the rotary movement of the shutter D.

In a preferred but non-exclusive embodiment of the invention, the working chamber 11 may be partitioned into two half-chambers 14 and 15, separated from each other by means of a hydraulic sealing element 35, for example a lip seal with relative o-ring, so that the working fluid exclusively lies in the half-chamber 15.

More generally, the hydraulic sealing element 35 may be substantially disc-shaped with a maximum outer diameter substantially equal to or larger than the inner diameter of the working chamber 11. The hydraulic sealing element 35 may include an elastomeric annular peripheral sealing element, for example an o-ring, designed to come into contact with the inner wall of the working chamber 11.

The hydraulic sealing element 35 may advantageously be slidably inserted into the working chamber 11, with the spring 40 acting thereon to push it against the working fluid.

In this manner, the hinge may be very simple to manufacture and assemble. As a matter of fact, the working chamber 11 may have a single diameter and it may be partitioned into two half-chambers 14 e 15 simply by means of the hydraulic sealing element 35. The inner wall of the working chamber 11 may be free of elements for abutting against the hydraulic sealing element 35, which will exclusively act against the head of the working fluid.

The shaft 34 for connection between the plunger element 30 and the cylinder 31 may suitably be arranged in both half-chambers 14 and 15, passing through the hydraulic sealing element 35.

In this manner, the half-chamber 15 may be the hydraulic half-chamber, while the half-chamber 14 may be the mechanical half-chamber, without hydraulic damping means. The spring 40 may be housed in the half-chamber 14. More in particular, the spring 40 may be interposed between the hydraulic sealing element 35 and an abutment wall 31' of the cylinder 31, at contact with both.

The half-chamber 15 may slidably house the plunger element 30, which may slide between the distal position and the proximal position from/to the bottom wall 12.

The plunger element 30 may partition the half-chamber 15 into two variable volume compartments 18, 19 placed in fluid communication with each other and adjacent to each other. More in particular, the working fluid flows from the compartment 19 to the compartment 18 upon opening the shutter D, while the working fluid back-flows from the compartment 18 to the compartment 19 upon closing the shutter D.

According to a particular aspect of the invention, the working fluid may flow through the plunger element 30. In particular, it may flow through it both when opening and when closing the closing element.

Preferably, provided for may be at least one hydraulic duct 60 which may place in fluid communication the compartments 18, 19 so as to allow the through-flow of the fluid from one to the other upon opening/closing the closing element D.

In particular, the plunger element 30 may be sealingly inserted into the working chamber 11, for example by means of an o-ring 38 so as to force the working fluid to flow through the hydraulic duct 60 as better explained hereinafter.

Furthermore, advantageously provided for may be adjustment means 62 acting on such hydraulic duct 60 so as to adjust the rotation speed of the shutter D between the closing and opening positions. For example, the adjustment means 62 may vary the through-flow area of the fluid in the hydraulic duct 60.

More in particular, as shown in the attached figures, the plunger element 30 may comprise a stem 131 and a head 135. The latter may suitably comprise the o-ring 38.

It is clear that the stem 131 and the shaft 34 may coincide, be obtained as a single piece or they may be integrally joined to each other so that the sliding of the former promotes the sliding of the latter or vice versa.

The head 135 may comprise a pair of disc-shaped elements 136, 140 which may be fitted onto the stem 131 and/or screwed thereonto.

In particular, the disc-shaped elements 136, 140 may be mutually slidable between a mutually distal position and a mutually proximal position. For example, one of the two may be movable to slide with respect to the other or both disc-shaped elements 136, 140 may be slidable.

According to a preferred but non-exclusive embodiment of the invention, the disc-shaped element 136 may be slidable along the stem 131 between a distal position from the disc-shaped element 140 and a position proximal to the disc-shaped element.

Preferably, the disc-shaped element 136 may be slidably inserted into the stem, while the disc-shaped element 140 may be inserted and screwed thereonto so as to move integrally joined with the stem 131.

The stem 131 may suitably comprise a step 132 having an abutment surface 133 for the disc-shaped element 136. The latter may thus remain substantially interposed between the step 132 and the disc-shaped element 140. In other words, the disc-shaped element 136 may have a surface 137 to end up in abutment with the abutment surface 133 and an opposite operative surface 138 that may remain facing the disc-shaped element 140.

The disc-shaped element 140 may thus have a corresponding operative surface 141 facing the surface 138. In particular, the disc-shaped element 140 may comprise a through hole 142 for the through-flow of the working fluid. Such through hole 142 may preferably be substantially parallel to the axis Y.

The disc-shaped element 140 may also comprise the o-ring 38 so as to force the working fluid through the through hole 142. More in detail, the o-ring 38 may cooperate with the working chamber 11 to force the working fluid through the through hole 142. In other words, the hydraulic duct 60 may comprise such through hole 142.

The operative surface 141 may suitably comprise an opening 143 fluidically connected with the through hole 142 which may remain substantially facing the operative surface 138 of the disc-shaped element 136.

The operative surfaces 141, 138 may thus be mutually faced so that when the disc-shaped elements 136, 140 are in the proximal position, the interspace between the operative surfaces 141, 138 defines a calibrated passage 150 for the working fluid.

Thus, in particular the hydraulic duct 60 may comprise the calibrated passage 150 and the through opening 143.

Figure 5:
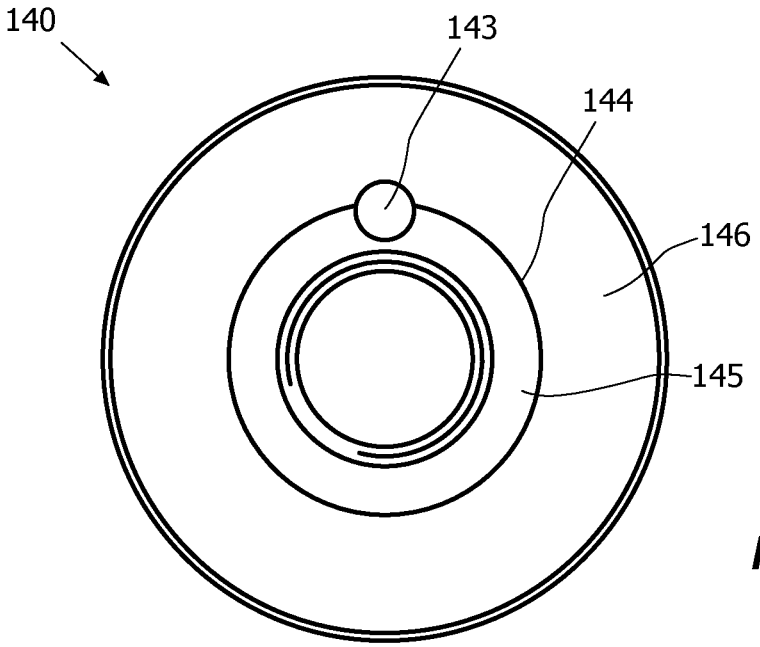
FIGS. 5 and 6 are a lateral view of some details of the hinge 1 according to two different embodiments.
Figure 6:
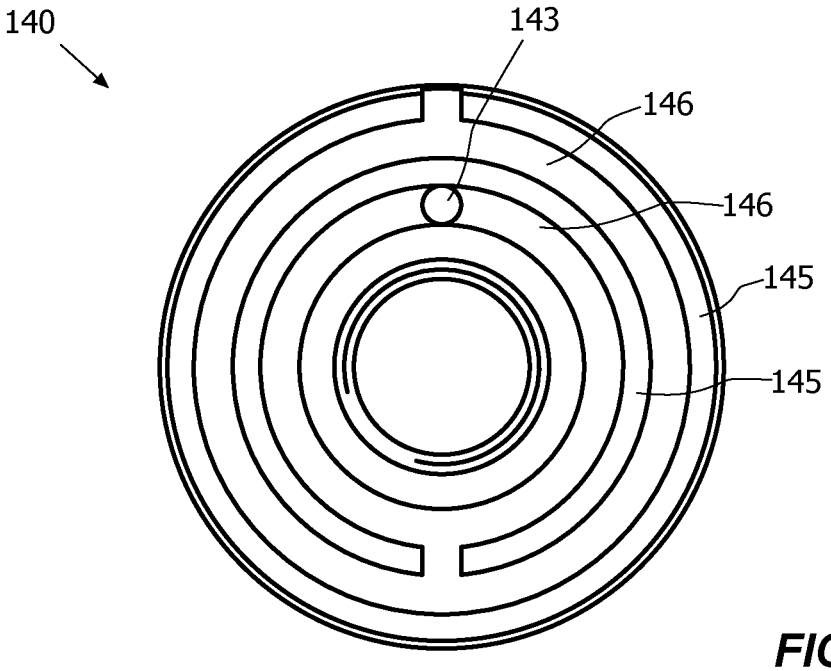

As schematically illustrated in FIGS. 5 and 6, the operative surface 141 may comprise an abutment area 145 and a working area 146 having different heights so that when the operative surface 141 is at least partly at contact with the operative surface 138, i.e. when the disc-shaped elements 136, 140 are in the proximal position, between the operative surfaces 141, 138 a shaped interspace defining the calibrated passage 150 is formed.

Even though the surface 138 may be substantially flat while the operative surface 141 may have areas 145, 146 defining the shaping, it is clear that the operative surface 138 may be shaped while the operative surface 141 may be substantially flat or both the operative surfaces 138, 141 may be shaped.

In any case, when the disc-shaped elements 136, 140 are in the proximal position, the working area 146 and the operative surface 138 may be mutually spaced apart while the abutment area 145 and the operative surface 138 may be in mutual abutment.

According to an embodiment of the invention for example illustrated in FIG. 6, the areas 145, 146 may be shaped so as to force the working fluid along a predetermined path. In this manner, the head losses may be particularly high.

It is clear that the opening 143 may be fluidically connected with the working area 146 so as to allow the through-flow of the fluid even when the disc-shaped elements 136, 140 are in proximal position. For example, the opening 143 may be at least partly arranged at the working area 146.

On the other hand, according to a different preferred but non-exclusive embodiment of the invention, the operative surface 141 may comprise an annular relief 144 so as to define the abutment area 145 susceptible to come into contact with the operative surface 138 and the working area 146 susceptible to remain spaced apart from the operative surface 138 even when the disc-shaped elements 136, 140 are in proximal position.

In other words, the operative surface 141 may have a notch which may thus have a predetermined height as better explained hereinafter.

When the plunger element 30 passes from the retracted end-stroke position to the extended end-stroke position, the disc-shaped elements 136, 140 may be in the distal position, while when the plunger element 30 passes from the extended end-stroke position to the retracted end-stroke position, the disc-shaped elements 136, 140 may be in the proximal position.

More in particular, when the plunger element 30 passes from the retracted end-stroke position to the extended end-stroke position, the compartment 18 may be compressed and the fluid contained therein may promote the sliding of the disc-shaped element 136 from the distal position to the proximal position. On the other hand, when the plunger element 30 passes from the extended end-stroke position to the retracted end-stroke position, the compartment 19 may be compressed and the fluid contained therein may promote the sliding of the disc-shaped element 136, 140 from the proximal position to the distal position.

In any case, the fluid may flow between the compartments 18, 19 through the hydraulic duct 60. Only one hydraulic duct 60 comprising the hole 142 may possibly be provided for.

As schematically illustrated in the attached figures, the opening 143 may suitably be arranged at the annular relief 144 so that at least one portion thereof is placed in fluid communication with the working area 146.

In this manner, even when the operative surface 138 is at contact with the abutment area 145, the operative surface 138 may be spaced apart from the working area 146 so as to allow the through-flow of the fluid from the compartment 19 towards the compartment 18 through the opening 143.

In other words, the working area 146 may be impacted by the flow of the working fluid, both when opening and when closing the closing element D.

When the disc-shaped elements 136, 140 are in proximal position, the hydraulic duct 60 may have a minimum through-flow area, while when the disc-shaped elements 136, 140 are in distal position the hydraulic duct 60 may have a maximum through-flow area.

It is clear that the length of the stroke of the disc-shaped element 136 may determine the maximum distance between the operative surfaces 138 and 141 and thus the maximum through-flow area of the hydraulic duct 60, while, as described above-once the operative surfaces 138 and 141 are at contact with the hydraulic duct 60 it may have the minimum through-flow area.

It is clear that the expression "through-flow area" of the hydraulic duct 60 is used to indicate the area for the through-flow of the working fluid considered on the hydraulic duct 60 between the compartments 18 and 19 at the minimum value thereof. For example, in proximity of a constriction.

For example, the through-flow area may be determined at the opening 143 and it may thus be given by the distance d1, d2 between the operative surface 138 and the working area 146 of the respective disc-shaped elements 136, 140.

In particular, the through-flow area may be minimum at the distal position of the disc-shaped elements 136, 140, and it may be minimum at the proximal position thereof which may correspond to the calibrated passage 150.

Thus, the disc-shaped elements 136, 140 may suitably act as adjustment means 62 of the hydraulic duct 60 in that the approaching/the moving apart thereof may promote the variation of the through-flow area of the hydraulic duct 60 and thus the section of the calibrated passage 150.

The relief 144 may advantageously be obtained in a simple and quick manner with a particularly high working precision.

Figure 7:
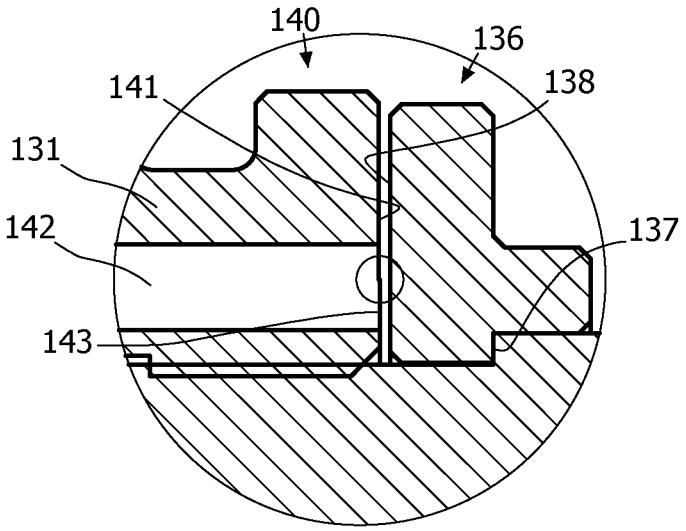
FIGS. 7 and 9 are enlarged sectional view of some details of the hinge 1 of FIG. 3 in different operative steps, with a further enlargement of FIGS. 7 and 9 in FIGS. 8 and 10.
Figure 8:
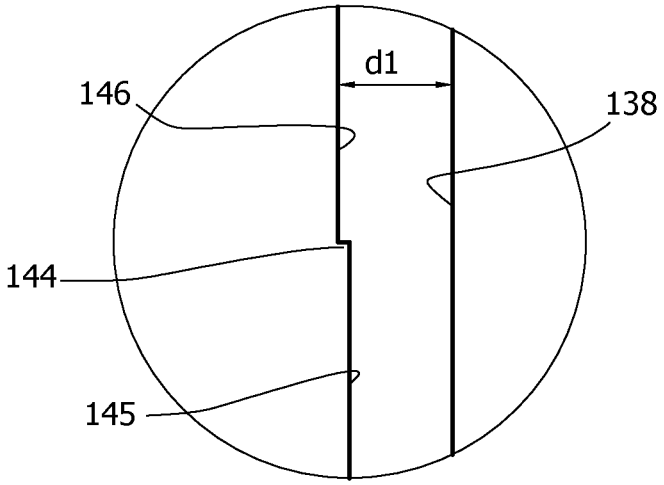
Figure 9:
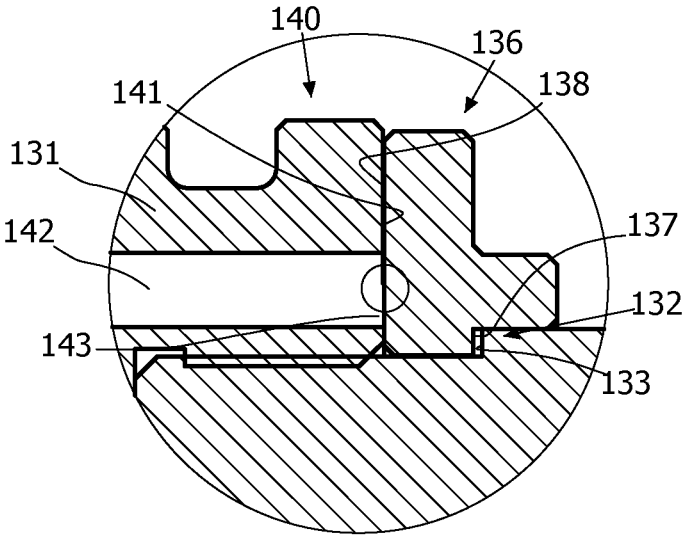
Figure 10:
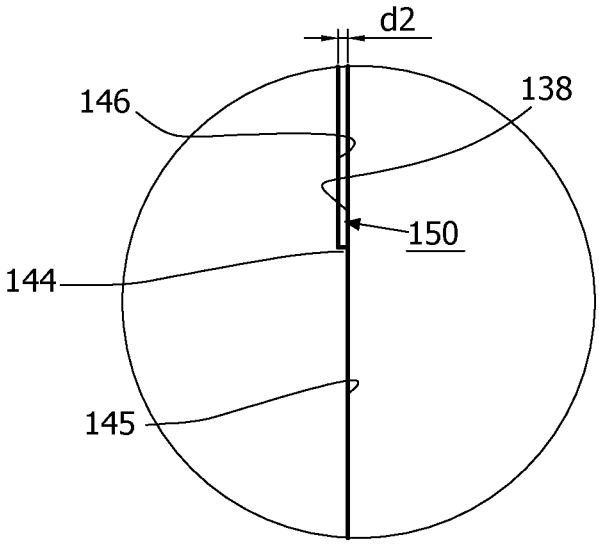
Figure 11:
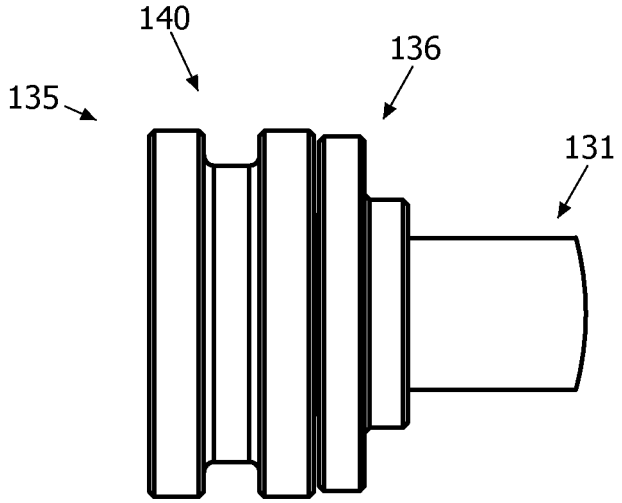
FIGS. 11 and 12 are a respectively lateral and sectional view of a different embodiment of the hinge 1 comprising elastic counteracting means.
Figure 12:
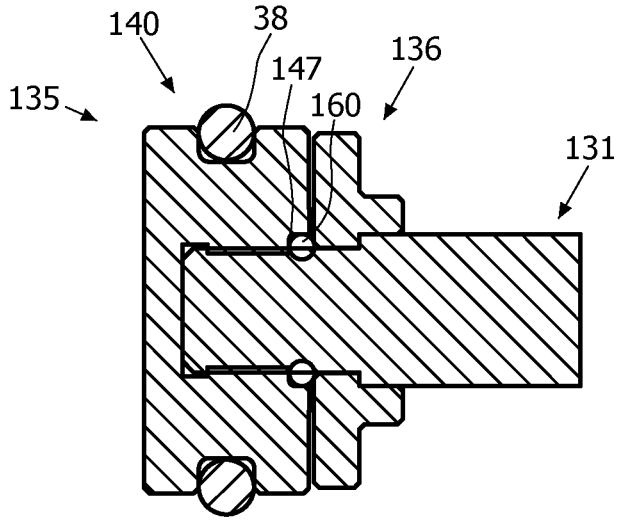

More in detail, when the disc-shaped elements 136, 140 are in distal position (FIGS. 7 and 8), the operative surface 138 and the working area 146 may be spaced apart by the distance d1 defining the maximum through-flow area, while when the disc-shaped elements 136, 140 are in proximal position (FIGS. 9 and 10), the operative surface 138 and the abutment area 145 may come into contact, while the operative surface 138 and the working area 146 may be spaced apart by the distance d2 defining the minimum through-flow area and thus the minimum section of the calibrated passage 150.

For example, the distance between the abutment area 145 and the working area 146, i.e. the distance d2, may be smaller than 1 mm.

In this manner, the through-flow area of the fluid when the disc-shaped elements 136, 140 are in the proximal position may be particularly small so that the damping of the rotation movement of the closing element D is particularly effective. Thus, this characteristic may allow to effectively control the opening or the closing of the closing element D.

With the aim of having a gradually damping action, suitably provided for may be elastic or viscoelastic counteracting means 160 between the disc-shaped elements 136, 140 acting on the latter. For example, such elastic or viscoelastic means 160 may counter the passing of the disc-shaped elements 136, 140 from the distal position to the proximal position. In other words, there may be an action for damping the sliding of the disc-shaped elements 136, 140.

It is clear that the elastic or viscoelastic means 160 may be configured so as to allow the disc-shaped elements 136, 140 to reach the proximal position.

An elastomeric ring 160 interposed between the operative surfaces 138 and 141 of the respective disc-shaped elements 136, 140 may for example be provided for.

According to a particular embodiment, the operative surface 141 may comprise an annular seat 147 for the elastomeric ring 160.

In the embodiments illustrated in FIGS. 1-12 the disc-shaped elements 136, 140 may be made of rigid material, for example a metallic material.

Figure 13A:
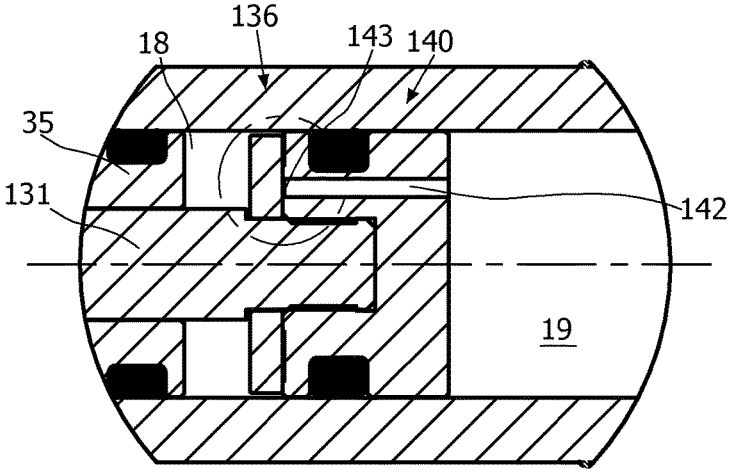
FIGS. 13A and 13B are sectional views of the head 135 of a further embodiment of the hinge 1, wherein the disc-shaped elements 136 and 140 are respectively in proximal and distal position.
Figure 13B:
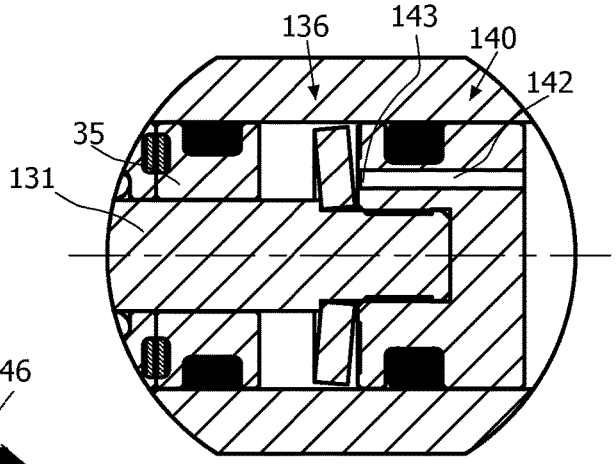
Figure 14:
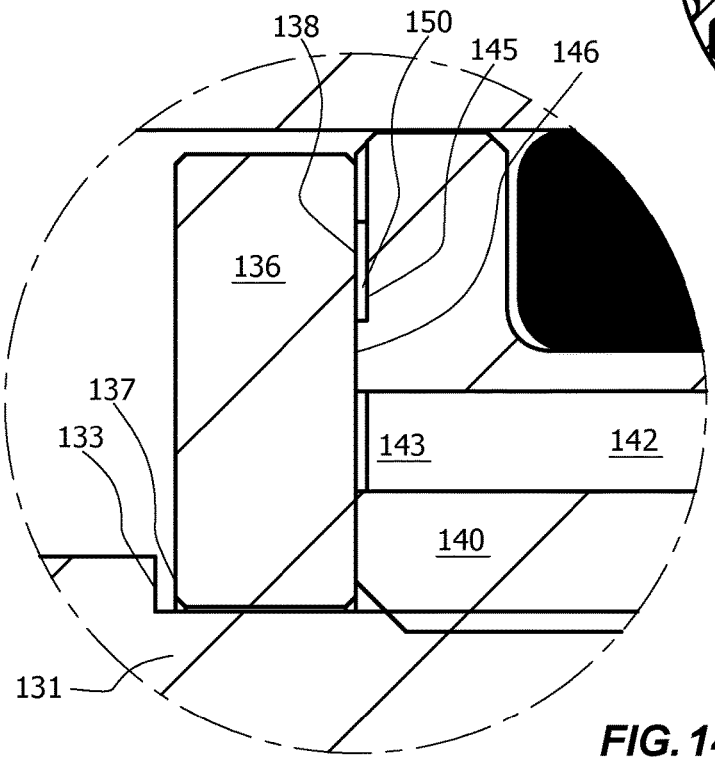
FIG. 14 is an enlarged view of some details of FIG. 13A.

On the other hand, in the embodiment illustrated in FIGS. 13A-14, at least one of the disc-shaped elements 136, 140 may be made of elastically yieldable material, an elastomer for example. In this manner, the elastic response of such material may compensate possible pressure deficiencies in the working chamber, besides generally guaranteeing an optimal behaviour of the hinge 1.

In light of the above, it is clear that the hinge according to the invention attains the pre-set objectives.

The hinge according to the invention is susceptible to numerous modifications and variants all falling within the inventive concept outlined in the attached claims. All details can be replaced by other technically equivalent elements, and the materials can be different depending on the technical needs, without departing from the scope of protection of the invention.

Even though the hinge has been described with reference to the attached figures, the reference numbers utilised in the description and in the claims are meant for improving the intelligibility of the invention and thus do not limit the claimed scope of protection in any manner whatsoever.

The invention claimed is:

1. A hydraulic hinge for the rotatable movement of a closing element between a closing position and an opening position, the closing element being anchorable to a stationary support structure, hydraulic hinge comprising:

a fixed element (20) adapted to be anchored to the stationary support structure; and a movable element (10) adapted to be anchored to the closing element, said fixed element and said movable element being mutually coupled so that the movable element rotates with respect to the fixed element around a first longitudinal axis (X);

wherein one of said fixed element (20) or said movable element (10) includes at least one working chamber (11) defining a second longitudinal axis (Y), said at least one working chamber (11) including at least one portion (14, 15) comprising:

a plunger element (30) slidable along said second axis (Y), said plunger element (30) being operatively coupled with another one of said fixed element (20) and said movable element (10) so that a rotation of the movable element (10) corresponds to a sliding of the plunger element (30); and a working fluid for hydraulically damping a movement of said movable element (10);

wherein said plunger element (30) comprises a stem (131) defining said second axis (Y) and a head (135) sealingly inserted into said at least one working chamber (11) to partition said at least one portion (14, 15) of the at least one working chamber (11) in at least one first and one second variable volume compartment (18, 19) fluidically communicating with each other;

wherein said head (135) comprises:

a first and a second disc-shaped element (140, 136) both inserted into said stem (131); and a hydraulic duct (60) to allow a through-flow of said working fluid from said first variable volume compartment (18) to said second variable volume compartment (19) and vice versa;

wherein at least one of said first and said second disc-shaped element (140, 136) is slidable with respect to another one thereof between a proximal position, in which a mutual distance therebetween is minimum and a distal position, in which the distance therebetween is maximum, so as to adjust a rotation speed of the closing element (D) between a closing position and an opening position;

wherein one of said first and second disc-shaped element (140, 136) has a first operative surface (141), which includes an opening (143) fluidically connected with said first and said second variable volume compartment (18, 19); and wherein another one of said first and said second disc-shaped element (140, 136) has a second operative surface (138), said first and second operative surfaces (141, 138) being mutually faced and shaped so that when said first and said second disc-shaped element (140, 136) are in said proximal position, an interspace between said first and said second operative surface (141, 138) defines a calibrated passage (150) for the working fluid, said hydraulic duct (60) including said calibrated passage (150) and said opening (143).

2. The hydraulic hinge according to claim 1, wherein said first operative surface (141) of said one of said first and said second disc-shaped element (140, 136) comprises a first working zone (146) and a second abutment zone (145), and wherein, when said first and second disc-shaped element (140, 136) are in said proximal position, said second abutment zone (145) and said second operative surface (138) are mutually in contact and said first working zone (146) and said second operative surface (138) are mutually spaced apart so as to define said calibrated passage (150).

3. The hydraulic hinge according to claim 2, wherein when said first and second disc-shaped element (140, 136) are in said proximal position, the distance (d2) between said second operative surface (138) of said other one of said first and said second disc-shaped element (140, 136) and said first working zone (146) defines a minimum section of said calibrated passage (150).

4. The hydraulic hinge according to claim 2, wherein said first operative surface (141) of said first disc-shaped element (140) has an annular relief (144) defining said second abutment zone (145), said opening (143) being placed in fluid communication with said first working zone (146).

5. The hydraulic hinge according to claim 1, wherein said stem (131) has a step (132) having an abutment surface (133) for said second disc-shaped element (136), said second disc-shaped element (136) being slidably interposed between said step (132) and said first disc-shaped element (140) and being at contact with the step or with the first disc-shaped element when said first and said second disc-shaped element (140, 136) are respectively in said distal or said proximal position.

6. The hydraulic hinge according to claim 1, further comprising elastic or viscoelastic counteracting means (160) interposed between said first and second disc-shaped element (140, 136) to act on the latter when they are passing from the distal position to the proximal position.

7. The hydraulic hinge according to claim 6, wherein said elastic or viscoelastic counteracting means (160) comprise an elastomeric ring interposed between said first and said second operative surfaces (141, 138) of said first and said second disc-shaped element (140, 136).

8. The hydraulic hinge according to claim 7, wherein at least one of said first and said second operative surface (141, 138) of said first and said second disc-shaped elements (140, 136) comprises an annular seat (147) for said elastomeric ring.

9. The hydraulic hinge according to claim 1, wherein said one of said first and second disc-shaped element (140, 136) comprises at least one hydraulic sealing elastomeric element (38) cooperating with an inner surface of said at least one working chamber (11) to force a through-flow of the working fluid through said calibrated passage (150) and said opening (143).

10. The hydraulic hinge according to claim 1, wherein upon both an opening and a closing of the closing element, the working fluid flows between said first (18) and second (19) variable volume compartment through said calibrated passage (150) and said opening (143).

11. The hydraulic hinge according to claim 1, wherein at least one of said first and said second disc-shaped element (140, 136) is made of an elastically yielding material.

* * * * *